US005830283A

United States Patent [19]

Frei et al.

[11] Patent Number: 5,830,283

[45] Date of Patent: Nov. 3, 1998

[54] METHOD FOR AVOIDING SEDIMENTATION

[75] Inventors: Alexandra S. Frei, Winterthur, Switzerland; Bernard Paringaux, Marsielle, France

[73] Assignee: Lindenport S.A., Collex, Switzerland

[21] Appl. No.: 698,397

[22] Filed: Aug. 15, 1996

Related U.S. Application Data

[63] Continuation of Ser. No. 292,233, Aug. 17, 1994, abandoned.

[30] Foreign Application Priority Data

Aug. 17, 1993 [CH] Switzerland ..... 02 469/93

[51] Int. Cl.[6] ..... B08B 3/10; B08B 7/02; B08B 9/00; B08B 9/08

[52] U.S. Cl. ..... 134/22.1; 134/1; 134/8; 134/34

[58] Field of Search ..... 134/1, 8, 22.1, 134/34; 210/696, 738

[56] References Cited

U.S. PATENT DOCUMENTS 5,078,799 1/1992 Matter et al. ..... 134/22.18

FOREIGN PATENT DOCUMENTS

| | | | |
|---|---|---|---|
| 202 217 | 11/1986 | European Pat. Off. . | |
| 2471953 | 6/1981 | France | 210/696 |
| 0248572 | 8/1987 | Germany | 210/696 |
| 58-145793 | 8/1983 | Japan | 210/738 |

*Primary Examiner*—Zeinab El-Arini
*Attorney, Agent, or Firm*—Walter C. Farley

[57] ABSTRACT

A method for preventing formation of a sediment layer at the bottom of a tank containing a liquid mixture such as crude oil, refinery products and petrochemical products which tends to form a precursor in the form of a thickening precipitation zone above the bottom. The deposit of sediment is prevented by disturbance of the precipitation zone. The disturbance is created in the form of an overall disturbance pattern with local disturbance regions with vibrating bodies such as strings or bells strings excitable to vibrate and immersed in the liquid mixture. Exciting elements including push and pull units cause the strings or bells to vibrate in fundamental and harmonic overtones and deflect components of the mixture as a function of the amplitude of said sound wave components.

9 Claims, 4 Drawing Sheets

METHOD FOR AVOIDING SEDIMENTATION

This application is a continuation of application Ser. No. 08/292,233, filed Aug. 17, 1994, now abandoned.

FIELD OF THE INVENTION

This invention relates to a method and an apparatus for avoiding sedimentation from liquid phases or the thickening of liquid phases or liquid mixtures such as oils, crude oil, refinery products and petrochemical products.

BACKGROUND OF THE INVENTION

During the storage of liquid phases such as oils, crude, refinery products and other petrochemical products, undesired sedimentation and thickening often occurs which will be discussed hereinafter in connection with the particular deposit-forming example of crude oil.

The liquid phase of crude oil is a mixture mainly consisting of hydrocarbons such as paraffins, aromatics and naphthenes, which are also accompanied by non-hydrocarbons or so-called impurities such as mud, water, dissolved salts, sulphur compounds, sand, etc. In certain circumstances prior to processing in refineries, the crude undergoes rough refining processes for the separation of impurities. It is then generally customary to store the crude oil to be processed and also the precleaned crude oil in large tanks. This involves holding times of varying lengths, which can be quite long in the case of stockpiling, and much shorter for operation-based storage locations.

Long holding times especially favor undesired deposit formation from crude in tanks. These deposits can be of different types, being e.g. favored by emulsions of water with hydrocarbon fractions, or can consist of segregates of heavy hydrocarbon fractions (hard waxes) or settled mud or salts. The result is a kind of oily mud which accumulates and is compressed on the bottom of tanks and leads to high costs and losses and which is referred to loosely as sludge.

Costs and losses are caused because the oil sludge reduces the capacity of the tanks and also binds crude oil or, in some cases, largely consists of thickened crude. Thus, apart from the costly space loss in the tank, storage leads to significant loss of raw material. In addition, the lost space cannot be recovered again if the sludge is stored in closed systems, i.e. tanks made available for this purpose, the undesirable alternative being a final storage which is prejudicial to the environment if the sludge is dumped into open pits or basins. In large tanks with a diameter up to 100 m, a height of 20 m and a corresponding capacity, sediment thicknesses of 1 to 2 m lead to a 5 to 10% capacity loss. In addition, the service and operation of the tanks is often made difficult because the oil sludge clogs the pumps, outflows from tanks have to be filtered, etc. Finally, down-times are linked with the removal of the oil sludge. If the oil sludge is not removed, it accumulates further and finally leads to the abandonment of sludged-up storage containers and the construction of new tanks. Apart from these storage costs the unprocessed oil sludge also represents a loss because, despite its impurities, it largely consists of utilizable hydrocarbons.

Several solutions are known for removing sediments from crude in tanks and two examples will now be given.

1) A first solution is proposed in U.S. Pat. No. 3,436,263 and French Patent 22 11 546, where cleaning substances are used for dissolving, or removing in bound form, the oil sludge. A disadvantage of this method is that, due to the cleaning substances which have been introduced, the liquified oil sludge is no longer usable because its composition has been changed by the additives and it must be disposed of in dumps or elsewhere. Such dumps are e.g. old tanks or so-called wasteland and constitute a serious pollution of the environment. Reprocessing of oil sludge is consequently not desirable using this method which, instead of combating the problem it only combats the effect. However, it is still possible to clean and reuse the tanks. The essential reason why the dissolved oil sludge cannot be processed is that the cleaning substances used represent impurities for processing in refineries, whose separation by standard cleaning methods involves great effort and is expensive and does not bear a positive relationship to the recovered crude.

2) Another solution is proposed in European Patent 160, 805, wherein hydrokinetic energy is used in order to dissolve, or suspend back into the liquid phase by means of turbulence, sedimented residues in tanks. Thus, oil sludge dissolved by crude as the dissolving substance can be returned to the process and processed in the refinery following standard cleaning procedures. This method does not prevent the formation of oil sludge but instead merely eliminates it. For this purpose, planned turbulence or eddy flows are generated, whose successive remote action is able to dissolve the deposits in an effective manner, even outside the direct injection zone. However, this requires a considerable investment. Mechanically moving components within the tanks, such as e.g. rotary liquefying lances, which hydro-kinetically activate the oil sludge and dissolve it in crude represent considerable expense. Thus, although this method leads to a high oil sludge recovery level, it is expensive. Under extreme environmental conditions, e.g. in sand or ice desert regions, this is undesired.

SUMMARY OF THE INVENTION

An object of the invention is to provide a method for largely avoiding the deposit of sediments from liquid phases or thickening in liquids or liquid mixtures such as oils, crude, refinery products and petrochemical products.

A further object is to provide such a method which is simple and safe to carry out, which is important because as a rule the storage units are monitored either little or not at all.

The basic principle of the invention is based on the observation that the precipitation from liquid mixtures, such as from crude in tanks, forms a "precursor", i.e. a preliminary event, in the form of a precipitation or thickening zone of precipitation which ultimately settles in the bottom of the tank, initiating oil sludge formation and causing increasing sedimentation. The formation of this precursor can be influenced or prevented by a relatively small disturbance or perturbation, so that deposit formation is suppressed. This precursor of sedimentation from crude comprises crude oil thickening in a precipitation zone, which "floats" or stratifies, so to speak, above a bottom surface of the tank. Crude constituents coagulate and polymerize in this zone of continuously increasing viscosity and are deposited in the form of sediments or the like and collect on the bottom of the tank as re-utilizable oil sludge and therefore form a slowly rising bottom surface over which the precursor continues to act.

According to the invention, the sedimentation from mixtures such as crude, as well as other oils, is avoided by disturbing this precursor. As opposed to a per se sensible crude recovery from the sediment, this constitutes a type of prevention technology which reduces or prevents the formation of sludge. This approach differs from the solutions given above because there is no oil sludge disposal; instead, formation of the disadvantageous oil sludge is prevented.

Most sludge formation is due to a type of gelling of the crude, which thickens and, during thickening, can be redissolved by stirring or agitating. During this phase, no dilution by additional crude is required. However, in large tanks, a simple effective mechanical agitating or stirring system is, as a practical matter, substantially impossible so that it is necessary to find another form of planned disturbance appropriate to the enormous tanks which takes advantage of any thixotropic properties of the fluid and prevents formation or continued existence of the precursor.

According to the invention, this is achieved by the formation of energy-transporting, travelling, transverse waves in the pre-sedimentation zone, which includes the precursor of the settled oil sludge, by vibrations or oscillations of disturbance means. Simple, maintenance-free disturbances, such as vibrations, are advantageously obtained by using mechanical vibratory bodies such as strings, bell-shaped diaphragms and the like, which are oscillated to introduce disturbance energy into the precursor of the sediment or deposit layer. Crossed strings, e.g., permit a good distribution of energy-rich antinodes at regions of strings where the deflection constantly decreases towards the fixing points. The same applies for bell-shaped diaphragms. Their oscillations form sound waves which excite the liquid phase in the tanks. The excitation of the strings and/or the diaphragms takes place with suitable devices which are slowly moved backwards and forwards by means of a reciprocating drive such as a crank. Strings are re-stimulated into oscillation by means of excitation elements at given intervals, after which they oscillate and transmit disturbance energy. Diaphragms are re-struck by striking elements at predetermined time intervals after which they oscillate and transmit disturbance energy. Such devices are substantially maintenance-free, robust, mechanically simple and easy to control.

The practical realization of the method according to the invention is advantageous because the disturbance of the precursor and the consequent prevention of sedimentation take place with a much lower expenditure for material and labor than recovery of crude oil or components thereof from sediment which has already been allowed to form and can, in particular, be performed with simple, proven and functionally robust equipment. A further advantage of the method is that the position and extension of the precursor, i.e., its location, can be specified and disturbance apparatus can be installed in a planned manner in the vicinity thereof, usually slightly above the bottom of the tank.

BRIEF DESCRIPTION OF THE DRAWINGS

Details of the method according to the invention are described in greater detail hereinafter with reference to the following drawings wherein.

DESCRIPTION OF THE PREFERRED EMBODIMENTS

Figure 1:
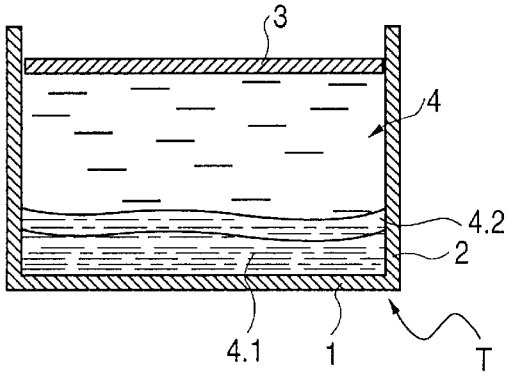
FIG. 1 is a side elevation, in section, of a tank with a settling zone and a sediment layer.

FIG. 1 is a schematic side elevation in longitudinal section through a tank having a diagrammatically represented precipitation zone 4.2, which is the above-discussed precursor, over a sediment layer 4.1. Tank T is a symmetrical cylinder with an approximately planar bottom 1, an annular wall 2 and a floating roof 3. The capacity of such a tank T can be 100,000 $m^3$ or more. Floating roof 3 is used for safety reasons, so as to permit the escape of volatile, flammable fractions of stored crude 4 from tank T and therefore prevent the formation of explosive mixtures within the tank. When tank T is wholly or partly filled, the roof floats directly on the crude 4. However, the method according to the invention can obviously also be used in a tank having a fixed roof.

FIG. 1 shows the sediment or deposit layer 4.1 and a thickening, precipitating or precipitation zone 4.2 above it. The sediment 4.1 can, e.g., comprise emulsions of water with hydrocarbon fractions, or segregates of heavy hydrocarbon fractions (hard waxes) or thickened crude or segregates of mud, sand, salts or rust and forms a deposit ranging in viscosity from a hard deposit to a thick oily mud generally known as sludge, which has settled on the bottom 1 of the tank T. These sediments 4.1 come from a precipitation zone 4.2 which thickens toward the bottom 1 of tank T and which floats above the bottom surface of the tank T, where it has a higher density than the crude oil 4 originally introduced into the tank above the sediment-forming zone. Observations have shown that the vertical thickness of sediment-forming zone 4.2 in such a tank can be up to 1 meter and is dependent on several difficult-to-determine parameters, such as the composition of the crude 4, the ratio of the hydrocarbon fractions, e.g., subdivided into paraffins, aromatics and naphthenes, as well as the proportion and nature of the impurities, e.g., the quantity of water or sludge.

As stated, this thickening pre-sedimentation zone 4.2 is a type of precursor for the sediment from crude 4. Thickening crude is a thixotropic mixture which changes from a viscous to a less viscous, liquid aggregate state when it is mechanically agitated. Thickening precipitation zone 4.2 forms as soon as a specific minimum or critical quantity of crude in a tank T has found a specific, metastable equilibrium, considered over a period of time.

The critical crude quantity is typically that which permits the formation of a precipitation zone 4.2. A metastable equilibrium occurs, as a function of the nature and manner of the supply, the supply capacity and also the duration of the crude supply (with or without disturbances) in the tank and this generally occurs after only a few weeks.

The crude in tank T can be influenced by external forces. One of these external forces, which cannot be suppressed, is gravity. Certain constituents of the crude 4 which thicken, coagulate and polymerize in a metastable precipitation zone 4.2 undergo a specific density rise with time in such a way that, under the action of gravity, they precipitate in precipitation zone 4.2 near the bottom surface of tank T so as to form bottom deposit 4.1. The possibilities of the coagulation, polymerization and precipitation of crude components 4 vary widely in accordance with the large variation range in composition of such a mixture and lead the deposit constituents into a stable equilibrium in the form of sediments or deposits 4.1 or oil sludge. Similar mechanisms of precipitation apply to other substances forming liquid phases.

This interaction of gravity with the precipitation zone 4.2 apparently fluctuates. Thus, there is an expansion and spatial positioning of precipitation zone 4.2 relative to the bottom surface of the tank T, i.e. zone 4.2 takes on the form of an eventual sediment layer. The statistical composition of the upper portion of sediment layer 4.1 influences corresponding structures of the upper and lower surfaces of the precipitation zone 4.2. The growth of sediment layer 4.1 is accompanied by a more or less constant thickening of precipitation zone 4.2 (see FIG. 1).

According to the invention, the sediment from mixtures such as crude, refinery products and petrochemical products in tanks T is avoided by disturbing the metastable precipitation zone 4.2 by external forces, so as to prevent coagulation and polymerization of components of the mixtures. Based on studies of the position of forming sedimentation, discovered by methodical sounding of intentionally permitted sediment formation and studying this formation and the extension or expansion of the precursor or precipitation zone 4.2 within the container, it is possible to apply to a tank T disturbing means having a planned action thereon. This method is illustrated in detail by FIGS. 2 to 4 using the example of crude oil. By "disturbing" it is meant that equilibrium in a portion of a liquid body is unbalanced by disturbing means such as vibrations so that it is mixed and its characteristics change. In particular, creating a disturbance leads to such agitation that thixotropic characteristics of any liquids in the mixture cause the thickening tendencies of the mixture to reverse, particularly, in the present invention, in a selected layer of the mixture.

Two advantageous embodiments of disturbing apparatus for the method are shown in FIGS. 7 to 10 in which the disturbance is brought about by producing energy-transporting, travelling waves by propagating vibrations or oscillations in tank T and exciting the components of the mixture in pre-sedimentation or precipitation zone 4.2. These oscillating components are moving and the precipitation zone 4.2 undergoes thorough mixing as a result of the incompressibility of the particles. FIGS. 11 to 15 show embodiments of disturbance means, a drive for the push and pull units for exciting purposes, as well as stretching devices for disturbance means in the form of oscillating strings.

Figure 4:
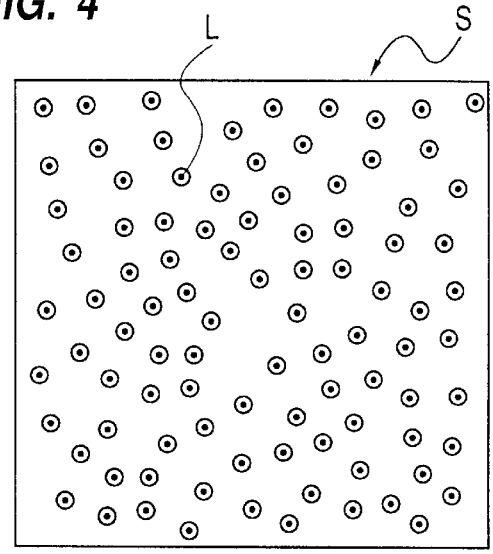
FIG. 4 is a second embodiment of a disturbance pattern in the form of two-dimensionally arranged pattern of disturbance regions.
Figure 5:
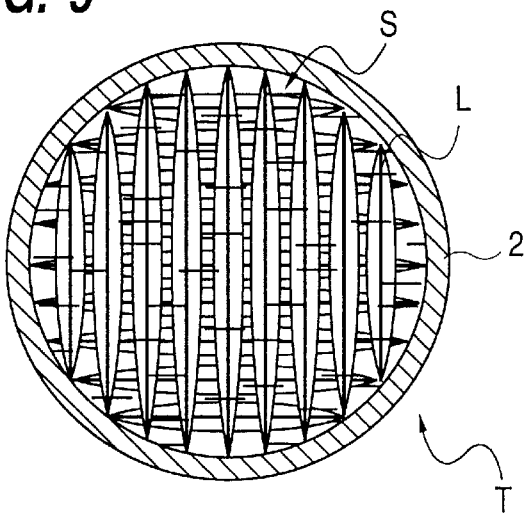
FIG. 5 is a plan view of a tank with the first embodiment of a disturbance pattern according to FIG. 3 superimposed thereon.
Figure 6:
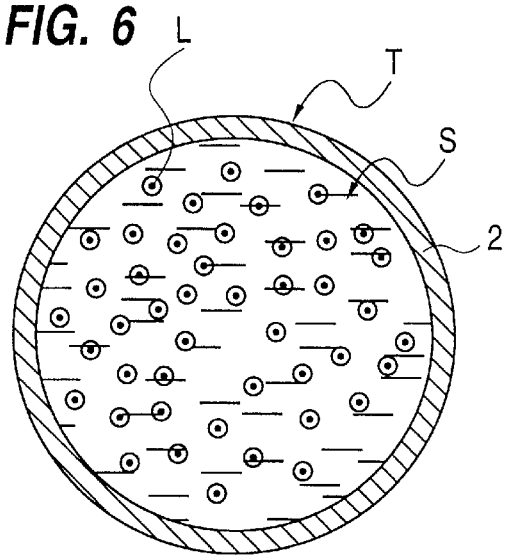
FIG. 6 is a plan view of the tank of FIG. 2 with the second embodiment of a disturbance pattern according to FIG. 4 superimposed thereon.

FIGS. 2 to 6 schematically show the method according to the invention in a plan view of part of a tank T (FIG. 2), the design of the disturbance pattern S in two embodiments (FIGS. 3 and 4) and the superimposing of the disturbance pattern S with the tank T (FIGS. 5 and 6).

Figure 2:
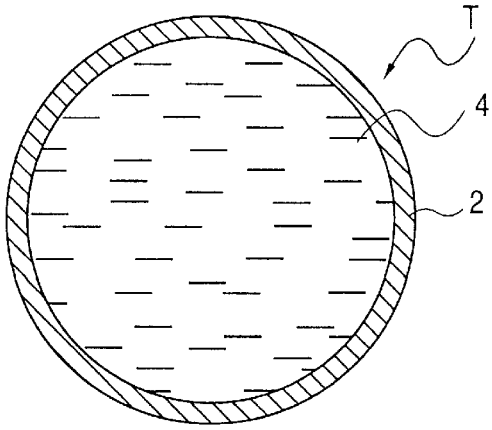
FIG. 2 is a plan view, in section, of a tank.

As is usually the case, in FIG. 2 the tank T is cylindrical and has a circular diameter of tens of meters and a height of up to 20 m. In such an enormous container there is disturbance zone having a vertical thickness of approximately 1 m which according to the concept of an overall disturbance pattern S, i.e. a disturbance model, is formed from a plurality of local disturbance regions L. This disturbance zone is advantageously created with a substantially constant disturbance height of about 0.5 meter above the bottom with a ±50 cm vertical disturbance action. The disturbance zone thus extends down to the bottom 1 of the tank T and has a volume of approximately several thousand $m^3$ (bottom surface area × the vertical height of the propagation of the disturbance). The disturbance of the precipitation zone 4.2 is, according to the invention, brought about by oscillations or vibrations and they are advantageously produced by means of strings or bell-shaped diaphragms located in the interior of the tank T. Thus, the disturbance model links and optimizes the shape of the tank T with that of the propagation of the vibrations in mixtures. With increasing knowledge of the action, specific disturbance models can be stored in a computer and can be modified and outputted as a function of the particular container, content, shape and environmental influences. According to the details of the optimized disturbance model it is then possible to select and design disturbance apparatuses.

Figure 3:
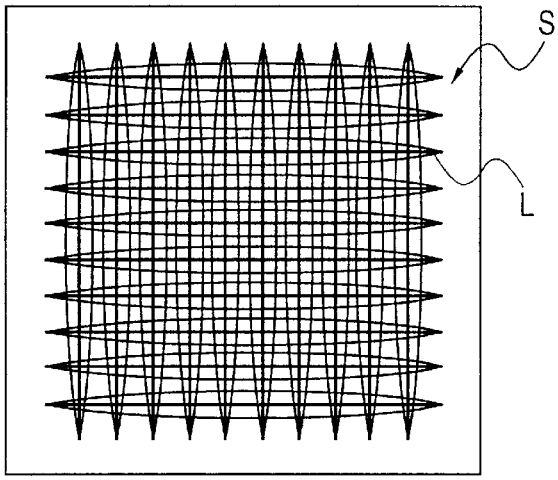
FIG. 3 is a plan view of a first embodiment of a disturbance pattern in the form of a three-dimensional array or pattern of disturbance regions.

In the first embodiment according to FIG. 3 the disturbance pattern S is shaped like a three-dimensional pattern of vibration-generating disturbance regions L and forms a two-layer, symmetrical arrangement of equidistant disturbance parabolas. The two layers of bulging disturbance zones of a generally parabolic form intersect at right angles and are suitable for long strings to be fitted and excited in the interior of the tank T in much the same way as two enormous harps, whose antinodes are superimposed in an optimum manner in this way. They are formed as strings having lengths up to 100 m which are excited by excitation elements, oscillate in fundamental and harmonic oscillations and in this way deflect the components of the crude oil 4 as a function of the size of the amplitude of the sound waves and therefore produce a mixing action.

The second embodiment of a disturbance pattern S according to FIG. 4 forms a two-dimensional pattern of disturbance regions L, which are designed as substantially equidistant, equally large disturbance circles. They are suitable for suitably dimensioned bell-shaped diaphragms which are installed and excited within tank T. Details concerning the construction of such disturbance means are given in connection with FIGS. 7 to 14.

The perturbation or disturbance regions L are preferably installed with optimum reciprocal spacing corresponding to the disturbance model, so that they are not too close together or too far apart and, in the disturbance zone between them, no undisturbed volume of the precipitation zone 4.2 can form. The sizes of the disturbance circles in FIGS. 3 and 4 do not represent the limits of the disturbance action of local disturbance regions L but rather merely indicate that each disturbance region L is designed in an "active" manner. It must also be borne in mind that the disturbing flows subsequently to be produced are propagated through the medium and therefore have a certain long-range action, which is greater than the external design limits of disturbance regions L and is also greater than the physical extension of the subsequently produced disturbance means.

To the extent possible, disturbance is to take place in a homogeneous manner and should fill the entire volume of interest. It is made local by means of the disturbance regions L and overall or global by means of the disturbance patterns S, with a view to preventing the formation of the precipitation zone 4.2 by means of such a disturbance zone. It is possible to form several geometries of disturbance patterns S, e.g. three-dimensional structures, which have closely packed disturbance regions L. The disturbance regions L need not be of the same size and it is possible to combine weaker and stronger disturbance regions L, which can be provided at regular or irregular intervals, e.g., longer or shorter, thick or thin, strings. It is therefore possible in this way to overcome difficult geometry conditions in a tank T where round walls, which consequently have a "stronger" design, must be disturbed. In addition, the disturbance regions L need not be symmetrical and can instead also be randomly arranged disturbance regions with individual disturbance capacities and geometries, which have a sufficiently long range to form interfering, overlapping disturbances, which in turn have a volume-filling, homogeneous design. Even the symmetrical disturbances can vary widely. Thus, the disturbance regions can be of a wide-range nature like flat disks, which are only uniform in one disturbance plane (e.g. sinusoidal and circular) or non-uniform (e.g. elliptical) and which here again act only in the predetermined disturbance height. This is advantageous, because the precipitation zone 4.2 to be prevented is relatively flat and shallow. With the knowledge of the invention, the expert is provided with numerous possibilities for the design of local disturbance regions L and overall disturbance patterns S.

The design of the disturbance pattern S can be brought about with standardized disturbance regions L in the form of a drawing board or on the computer as a disturbance model. An advantageous tool for this purpose is electronic data processing, where complete libraries of models can be built up, field experience can be stored and converted into sets of parameters. The disturbance patterns S and disturbance regions L are then selected from a set of standardized, proven forms and, in accordance with the parameters to be fulfilled, are matched to the given geometry of the tank T or the nature of the crude 4.

FIGS. 5 and 6 show a way in which this can be done. In FIGS. 5 and 6 the disturbance patterns S according to FIGS. 3 and 4, respectively, are superimposed on the surface area of the tank T according to FIG. 2, so that the numerous disturbance regions L within the disturbance zone within the tank T can be produced by means of disturbance apparatus. The disturbance pattern S is projected onto the geometry of the tank T, there being no need to proceed in a categorical manner and instead projection can take place as a function of the type and extension of the disturbance regions L. Thus, in FIG. 5 two layers of bulge-shaped disturbances L have amplitudes which are short compared to the lengths of the vibrating strings which produce them so that they "fit" into tank T. However, in FIG. 6 certain of the disturbance region locations L within the surface area of the tank T are not used; only those disturbance regions L found to be necessary for a specific geometry of tank T are created by the disturbance apparatus.

The disturbance zone comprises a volume defined by the surface area of the tank T and a disturbance depth and includes the precipitation zone to be disturbed. For this purpose the disturbance regions L are advantageously realized as disturbance apparatuses in the form of strings or bell-shaped diaphragms. Each string or bell-shaped diaphragm is an actual local disturber with a local disturbance volume.

Figure 7:
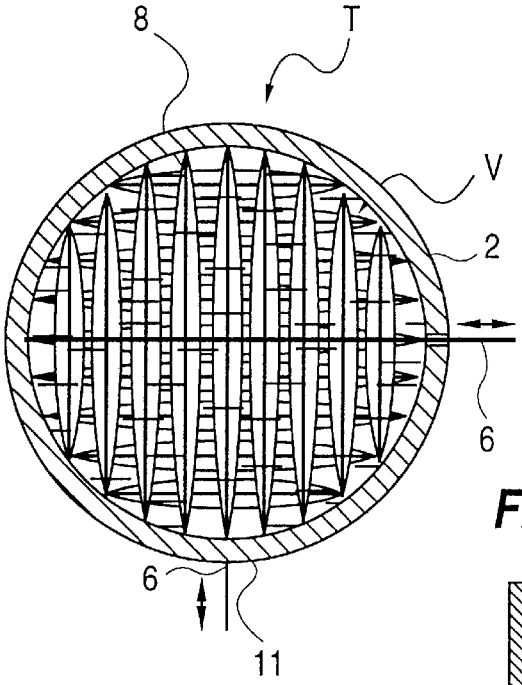
FIG. 7 is a plan view of a first embodiment of a disturbing apparatus of the method according to the invention.
Figure 8:
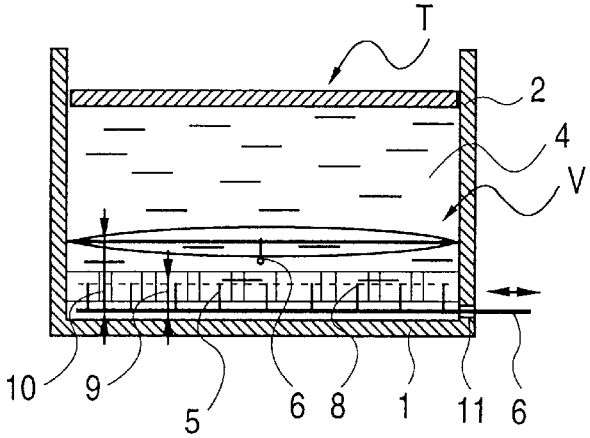
FIG. 8 is a side view of the first embodiment of a disturbing apparatus of the method according to FIG. 7.

FIGS. 7 and 8 schematically show a first embodiment of a disturbance apparatus V functioning according to the method of the invention. FIG. 7 is a plan view and FIG. 8 a side view. The geometries of the disturbance apparatus V with their disturbance means 8 and the tank T are adapted to one another, so as to achieve an optimum, i.e. volume-filling, homogeneous disturbance. The disturbance apparatus has excitable disturbance means 8 in the form of strings. In the tank T, the disturbance means 8 are arranged as equidistant, strings of different lengths supported at two constant disturbance heights 9, 10 above the bottom 1 of tank T, e.g. at a height of 40 cm (lower disturbance height 9) and a height of 80 cm (higher disturbance height 10). The disturbance zone covers the entire surface area of the tank T. With a disturbance action of ±50 cm, the zone extends down to the bottom 1 of tank T and encloses precipitation zone 4.2 the formation of which is to be disturbed or prevented.

The stretched strings of this embodiment of the disturbance apparatus V are excitable by means of exciting elements 5 by means of two push and pull units 6. The strings are advantageously excited to oscillate or vibrate in the center of their length. Such exciting elements 5 can be mandrels or spring-back striking means, which are fitted to push and pull units 6. The stationary or slightly vibrating strings are excited by moving the exciting elements 5 backwards and forwards. The exciting elements 5 are moved up to the strings to be excited, which are deflected, stretched (by plucking) and released. The exciting element 5 moves away from the strings allowing the string to vibrate in an undisturbed manner. The strings, their stretching devices and the push and pull unit 6 for the exciting elements 5 are advantageously fitted in several planes, so that the vibration of the strings and the moving backwards and forwards of the push and pull units 6 with the exciting elements 5 do not interfere with each other.

As a function of their lengths, the strings can be stretched to varying extents and can also be of different thicknesses. They are made from stiff materials made from metals such as steel, copper, alloys and possibly plastic and metal-coated plastics. The prerequisite is that the materials are resistant to attack by the crude oil 4 and can be vibrated. Despite tension and lift, long strings must not sag to such an extent that they are in contact with the bottom 1 of the tank T or another layer of strings. More details concerning the strings, their excitation and the stretching device are provided in connection with FIGS. 12, 14 and 15.

Push and pull units 6 have rigid members (rods, plungers) or movable members (chains which can be pushed/pulled), which slide in slotted, tubular guides or the like and exciting elements 5 for plucking or striking are attached thereto for the purpose of exciting the strings. In this first embodiment, push and pull units 6 are at right angles to one another and run linearly in two planes and are movable by means of crank-operated, fluid-operated or gear-operated drives positioned outside tank T. Details concerning an advantageous embodiment of such a drive are provided in the description of FIG. 11. Push and pull units 6 are typically mounted on stands or similar devices connected to the slotted, tubular guides at the bottom of tank T and the rigid or movable members can be led to the outside through the floating roof 3 by means of passages 11 through wall 2, at the bottom 1 or the top of tank T. For safety reasons, passage 11 must be tight, so that push and pull units 6 can be operated without any escape of liquid components of the mixtures to be processed, such as crude 4, from tank T. For plucking or striking the strings, push and pull units 6 need only be moved backwards and forwards over relatively short distances compared with their length resulting from the size of the tank T, of 10 cm to, at most, 1 m. The force expenditure for driving push and pull units 6 is also relatively small and they are mounted so as to slide in the guides without significant frictional losses and are lubricated by the crude oil in the tank. The parts of the push and pull units 6, such as the rigid or movable members, the tubular guides and the exciting elements 5, are advantageously made from metals such as steel, bronze, etc., optionally plastic and metal-coated plastic, so that they cannot be attacked by the surrounding media, so that the drive for the strings is substantially maintenance-free. The disturbance means are mechanically only slightly stressed. By appropriate choice of materials, the components are planned in such a way that the strings are kept in use, whereas the exciting elements are exposed to wear and can easily be replaced if inspections show a need. The strings can be detachably fixed to the push and pull units 6.

The strings produce relatively energy-rich vibrations of approximately 1 to 10 watts and have advantageously low (sub-audible) frequencies. With the knowledge of the present invention, the expert has numerous possibilities for producing such disturbing apparatus V.

Figure 9:
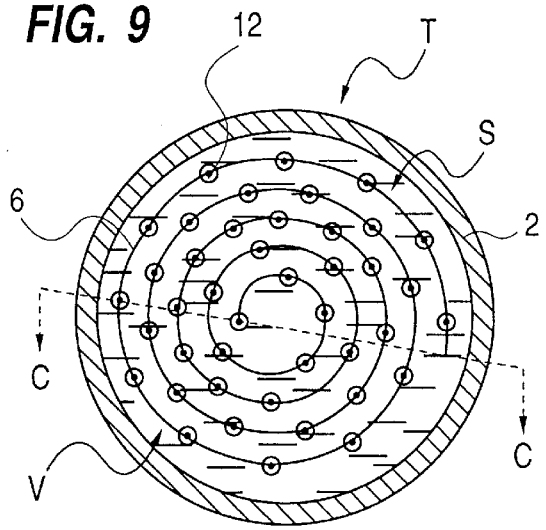
FIG. 9 is a plan view of a second embodiment of a disturbing apparatus of the method according to the invention.
Figure 10:
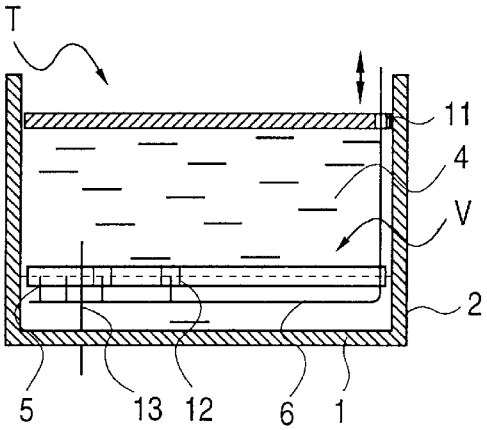
FIG. 10 is a side view of the second embodiment of a disturbing apparatus for the method according to FIG. 9.

FIGS. 9 and 10 schematically show a second embodiment of a disturbing apparatus V for performing the method according to the invention. FIG. 9 shows a plan view and FIG. 10 and side view along line CC of FIG. 9. The description of this second embodiment is similar to FIGS. 7 and 8 and only differing features will be referred to hereinafter.

In tank T, having cylindrical geometry and the same volume as described hereinbefore, local disturbance regions are formed as approximately equidistantly arranged disturbance means 12 in the form of bell-shaped diaphragms or short strings, which are at a constant disturbance height 13, typically 50 cm, above the bottom 1 of tank T, so that the disturbance zone encompasses the entire surface area of the tank T and, with a disturbing action of ±50 cm around the disturbance height 13, extends to the bottom 1 of the tank and therefore covers precipitation zone 4.2. Disturbance means 12 can be excited by means of exciting elements 5 via a push and pull unit 6. Unit 6 comprises movable members such as chain and is therefore spatially flexible. It can e.g. comprise chain links rotatable against one another and which are guided in slotted, tubular guides. In this embodiment, the guide and chain is laid in a spiral plane in the interior of the tank T. The guide is supported at the bottom of tank T and the chain is led to the outside in the floating roof 3 through passages 11 at the top of tank T. The exciting elements 5 can be small mandrels or sticks which are attached to push and pull units 6. The stationary or slightly vibrating bell-shaped diaphragms or strings are excited by forward and backward motion of exciting elements 5. Advantageous embodiments of such bell-shaped diaphragms or strings are described relative to FIGS. 12 to 15. The disturbance means 12 of the second embodiment have smaller external dimensions than the disturbance means 8 of the first embodiment. The spatially flexible push and pull unit used can be laid in large lengths from a roll in accordance with a given disturbance pattern S or model.

Figure 11B:
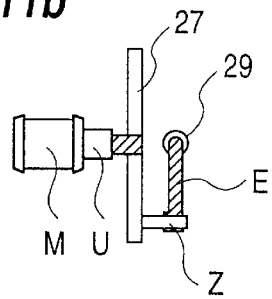
FIG. 11*b* is a side view of the drive of FIG. 11*a;*
Figure 11A:
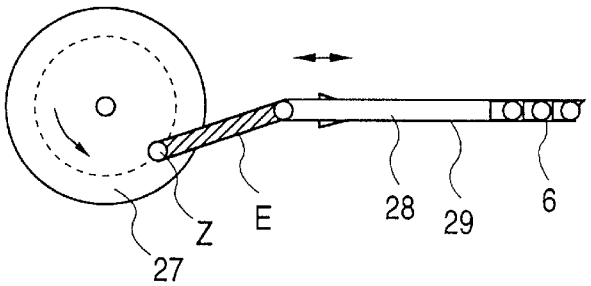
FIG. 11*a* is a schematic front view of an embodiment of a drive for a push and pull unit having a crank gear to drive excitation elements.

FIGS. 11*a* and 11*b* are schematic front and side views, respectively, of an embodiment of a drive for a push and pull unit 6 having a crank gear which drives exciting elements 5. This drive can be installed alongside tank T or on its floating roof 3 and comprises a hydraulic motor M with a power of a few kilowatts. A reduction gear transmission U drives a slowly rotating flywheel 27 at a speed of approximately 5 to 10 revolutions per minute. One end of a connecting rod E is rotatably attached to a pin Z connected to flywheel 27 so that the pin rotates with the wheel and carries the end of rod E with it. The other end of connecting rod E is rotatively attached to a piston 28 which is attached to push and pull unit 6 to be driven. When flywheel 27 rotates, piston 28 is moved linearly forward and backward in a guide 29. The extent of the forward and backward movement of push and pull unit 6 is twice the circular radius of pin Z on flywheel 27 and can therefore be varied by modifying that radius in a relatively simple manner in steps of 10 cm to 1 m. The speed of the forward and backward movement of the push and pull unit can be easily and precisely set by varying the rotational speed of the motor M, e.g. by varying the ratio of reduction gear U. This is important, because the vibrating behavior of disturbance apparatuses v in tanks T can in this way be externally regulated and controlled. It is also a very slowly running drive unit, which is suitable for permanent operation and scarcely requires any maintenance.

Figure 12A:
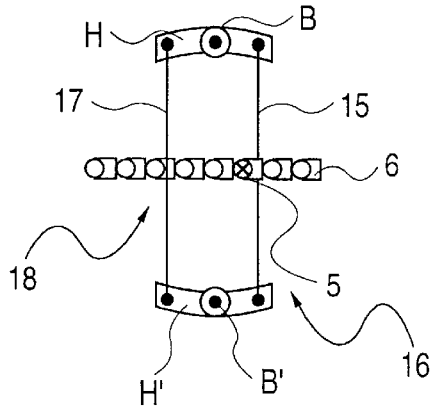
FIG. 12*a* is a schematic side elevation of a preferred embodiment of a disturbance means in the form of an oscillatory string system with a first embodiment of a stretching device.
Figure 12B:
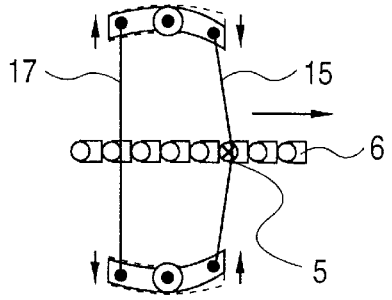
FIG. 12*b* is a schematic side elevation of the device of FIG. 12*a* showing how the oscillating string system and its stretching device are stretched following contact with an excitation element.
Figure 12C:
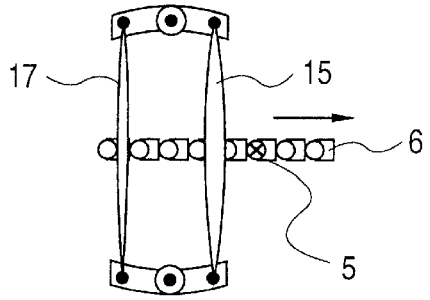
FIG. 12*c* is a schematic side elevation of the device of FIGS. 12*a* and 12*b* showing how the oscillating string system and its stretching device oscillate after excitation by an exciting element.

FIGS. 12*a–c* show a preferred embodiment of a disturbing means 8, 12 comprising a vibratable multiple string apparatus 18 with a first embodiment of a stretching device 16. FIGS. 12*a–c* show how the strings of apparatus 18 are stretched following contact with an exciting element 5 and associated stretching device 16 and how the two strings 15, 17 of the apparatus 18 vibrate following said excitation.

Apparatus 18 has two strings 15, 17 and can be mounted on the bottom 1 of tank T, together with its stretching device 16, using supports B, B', a plurality of apparatus 18 being arranged in accordance with a desired disturbance pattern S. This embodiment has the advantage that stretching device 16 cooperates with two flexible fastening means H, H' which are similar to blade springs and that strings 15, 17 attached to the fastening means are alternately placed under tension. When chain 6 is moved to the left in FIGS. 12*a*, exciting element 5 slides past string 15. On the return stroke, element 5, which can be shaped like a pawl, tensions and stretches string 15. After a desired amount of stretching, the string slips from element 5 and vibrates. The string tension is compensated in the same way as in a bow by strings 15, 17 and the fastening means. In this embodiment, supports B, B' need only withstand relatively small string tensions, so installation expenditure for powerfully designed supports are saved. Particularly when using thick steel strings with a diameter of e.g. 10 mm, a stretching or tensioning device would need to be able to withstand considerable tensions, which need is obviated by this opposite tensioning or stretching of the strings.

The tensioning or stretching device 16 can also fulfil other functions, such as providing tension via flexible supports H, H'. Strings 15, 17 of apparatus 18 are excitable simultaneously or in time-staggered manner, but only individual specific strings are excitable for vibration purposes. If, for example, only one string 15 is deflected from its equilibrium position for vibration excitation, according to FIG. 12*b* after contact with an exciting element 5 and as a result of the movement of push and pull unit 6, it is transversely tensioned in its longitudinal extension as shown by the arrow, so that supports H,H' are deflected inwardly and bend somewhat at the attachment points of spring 15 and are tensioned like springs so that the other string 17 is also tensioned. In this way the entire system stores energy. The exciting energy is therefore transferred into the strings 15, 17 and into supports H, H', so that when contact with the exciting element 5 is released, the system relaxes and starts to vibrate. As shown by FIG. 12*c*, strings 15, 17 vibrate through opposing excitation with different amplitudes. Therefore it is sufficient to excite vibration of one string 15 of an apparatus 18 with an exciting element 5 and as a result other string 17 also vibrates, and vice versa.

Strings 16, 17 can be excited in natural or harmonic vibrations and emit sound waves. The sound pressure level falls exponentially with time and the dying away of the amplitude of the vibrations due to frictional forces with the medium surrounding the same is delayed by the excitation of several strings 15, 17. Such a unison group as shown in FIGS. 12*a–c* produces coupled "sympathetic" oscillations or vibrations, which form a long, lingering sound due to phase shifts.

Figure 13:
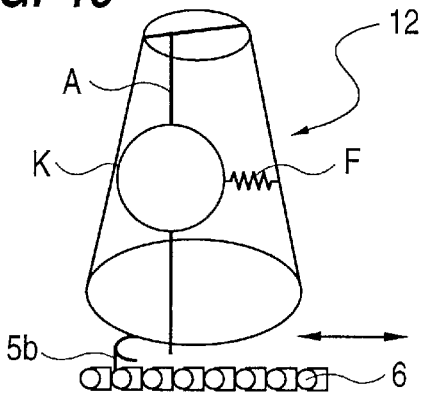
FIG. 13 is a perspective view of another embodiment of a disturbing means in the form of an oscillating, bell-shaped diaphragm.

FIG. 13 shows a third embodiment of a disturbing means in the form of an oscillatory bell-shaped diaphragm 12. Such a bell-shaped diaphragm can be excited to one or two natural modes of vibration or oscillation and therefore has several harmonic oscillations or vibrations. It requires no stretching devices and several such diaphragms can be mounted in accordance with a disturbance pattern S on the bottom 1 of tank T. It is excitable by means of an exciting element 5, which can, in an embodiment not shown, be connected to the bell-shaped diaphragm by means of an elastic connection. Thus, an exciting element 5 in the form of a striker-free, bell-shaped diaphragm movable by means of push and pull unit 6 can directly strike by moving forwards and backwards. FIG. 13 shows an embodiment in which push and pull unit 6 carries a concave deflector 5*b* which is positioned to engage a contact arm A and deflect the contact arm which is attached to a striker K fitted in or on the bell-shaped diaphragm. The striker K can be biased in a relative equilibrium position with respect to the diaphragm by the inherent stiffness of contact arm A, this pretension being represented in a schematic form by a compression spring F. By moving forward and backward as illustrated by the double-headed arrow, push and pull unit 6 moves arm A and then releases the contact arm A, allowing the striker to forcibly strike the diaphragm, causing vibrations. The exciting element 5 is then moved back in the opposite direction. During this return movement of push and pull unit 6, there is no force-transferring contact between them because two convex areas come into contact, which laterally slide past one another.

Figure 14:
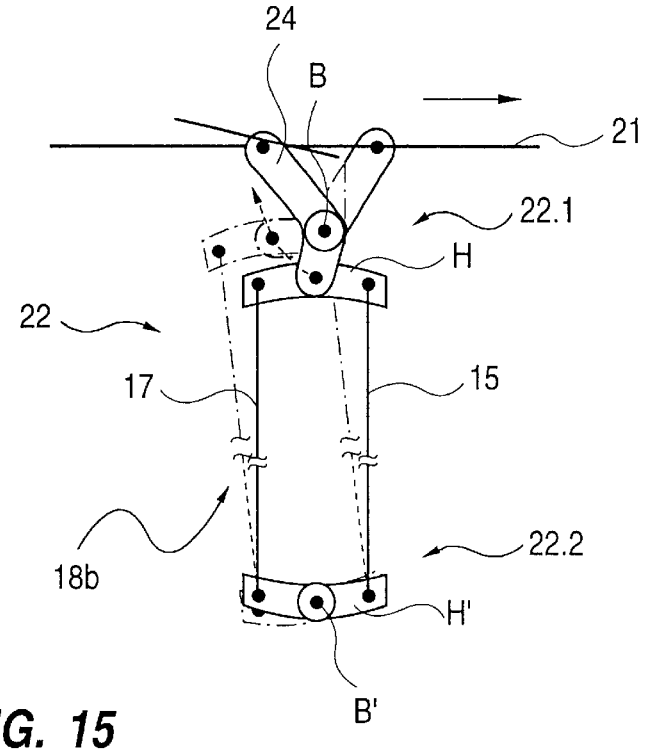
FIG. 14 is a schematic plan view of a second embodiment of a stretching device for oscillating string systems.
Figure 15:
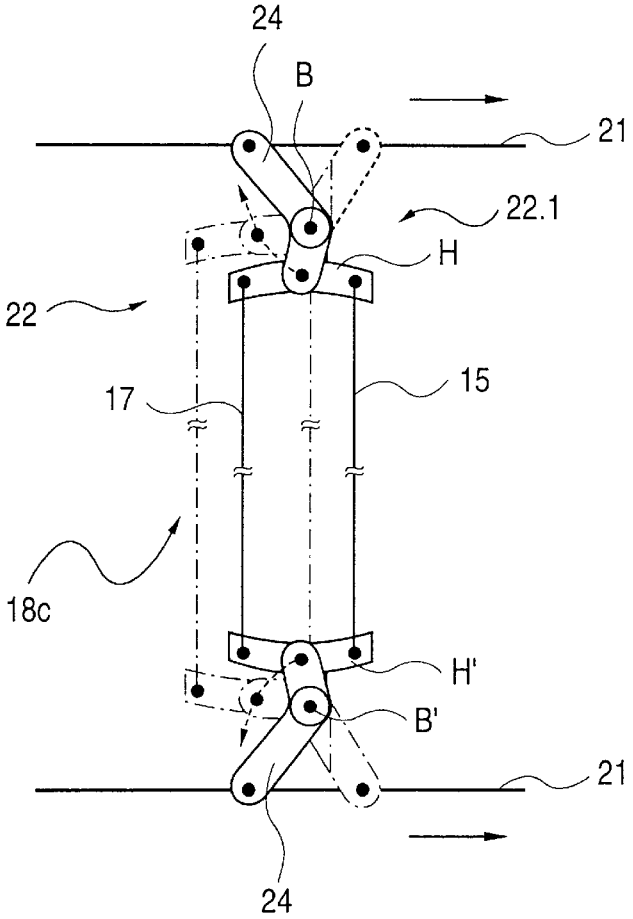
FIG. 15 is a schematic plan view of a third embodiment of a stretching device for oscillating string systems.

In FIGS. 14 and 15 are schematic views of second and third embodiments of stretching devices 18*b* and 18*c* for vibrating multiple strings. These stretching devices permit a simple arrangement of strings 15, 17 to be stretched in the disturbing apparatus according to the invention and permit easy adjustment of string tension which is also useful following the installation of the disturbing apparatus when the tank T is filled with crude oil 4. Thus, the tension force of the stretching devices can be adjusted. In the embodiment according to FIG. 14, string tension is adjusted in single-acting manner by means of one of the two attachment means H, H', whereas in the embodiment according to FIG. 15 the string tension is adjusted in a double-acting manner by means of both flexible supports H, H'.

A bellcrank 24 is rotatably mounted on a retaining mandrel B, which is fixedly mounted in the container, and spring support H is rotatably carried at one end of bellcrank 24. Support H' is rotatably mounted on mandrel B'. Strings 15 and 17 are stretched between supports H and H'. A push and pull device, which can also be similar to the guided chain structures discussed above or which can be a cable 21, is attached to the other end of bellcrank 24 and extends to the outside of the tank. By exerting force on cable 21 in the direction of the arrow, the bellcrank rotates, pulling with it flexible support H so that the strings are stretched, as shown by the broken line position in the drawing. These tensioning push and pull units 21 drive stretching elements 22 fixed thereto. In much the same way as the push and pull units 6 for producing vibrations, they can be laid in tank T in accordance with a disturbance pattern S and the resulting local position of the disturbance means 8, 12 and can be mounted on the bottom 1 of the tank. With the knowledge of the present invention the expert has numerous possibilities for producing such stretching or tensioning mechanisms.

FIG. 13 shows a bell-shaped membrane 12 with a clapper K. the clapper is dislocated from a rest position by a claw 5 which acts against a spring force F. When the clapper is released, it swings back, strikes the membrane and creates a sound. The claw is suitably rounded so that it slips from the clapper when sufficient force is developed during the dislocation.

According to FIG. 14, a stretching element 22 for multiple strings comprises a movable part 22.1 and a static part 22.2. In the embodiment of FIG. 15, a stretching element 22 for multiple strings comprises two movable parts 22.1 which can be identical to each other or mirror images. Static part 22.2 is a flexible support H with fixing points for the ends of the multiple strings 15 and 17 and is freely rotatable on a support B which is fixed on the bottom 1 of tank T. The movable part 22.1 has a similar flexible support H' with attachment points for the multiple strings. For this purpose it is rotatably attached to a hinged support, such as bellcrank 24, which is in turn rotatable on a support B' and is rigidly connected to the tensioning push and pull unit 21. In FIGS. 14 and 15, the supports B, B' are largely covered by the flexible supports H,H'.

The string tension can be suitably changed so that a movement of the tensioning means 21 in the direction of the long arrows brings about a rotation of the hinged supports 24 around the support B (indicated by the curved arrows), which draws apart flexible supports H, H' relative to their original positions and tensions strings 15, 17. Hinged supports 24, flexible supports H,H' and strings 15, 17 are shown in broken line form in the tensioned positions. The flexible supports H,H' of the ends of the strings are freely rotatable so that they are reciprocally oriented in accordance with the tension of strings 15, 17.

In the embodiment of FIG. 14, rotation of movable part 22.1 and securing of static part 22.2 of the stretching element 22 leads to a positional change of the multiple strings and at a certain angle it is inclined relative to the original position, which is not the case in the embodiment according to FIG. 15, where the two mobile parts 22.1 rotate.

The asymmetrical construction of the bellcrank 24 provides leverage or mechanical advantage in which long movement of the push and pull units 21 with a relatively small force brings about a small deflection of the longer end of the bellcrank, but with a greater force on the flexible supports H,H'. Compared with the single-acting stretching device according to FIG. 14, the double-acting stretching device according to FIG. 15 can be tensioned with greater force or, for the same force, a larger number of multiple string devices can be tensioned. These two tension-adjustable stretching devices permit a simple and rapid fitting or replacement of strings 15, 17. By relieving or relaxing the stretching device (rearward movement of the tensioning push and pull unit 21 contrary to the direction of the arrows) any tension strings 15, 17 are simultaneously relaxed and can then be loosely connected with flexible supports H, H' of the multiple string devices 18 (e.g. by means of snap closures, spring hooks, etc.) and the disturbing apparatus is made ready to operate by tensioning the stretching device

What is claimed is:

1. A method for inhibiting sedimentation or stratified thickening in a container containing a liquid having a tendency to form a sedimentation precursor followed by deposit of sediment in a precipitation zone adjacent the bottom of the container, the method comprising, prior to the deposit of sediment on the bottom of the container, establishing a three-dimensional array of a multiplicity of disturbance regions distributed throughout the sedimentation precursor and thickening precipitation zone;

generating vibrations at each of the disturbance regions within the liquid; and propagating the vibrations through the precursor and precipitation zone to fill the entire volume of the precipitation zone to disturb the formation of the precursor and thereby inhibit precipitation.

2. A method according to claim 1 wherein the disturbance regions comprise vibratory bodies in the container and vibrations are propagated by repeatedly exciting the vibratory bodies into oscillation.

3. A method according to claim 2 and including arranging the vibratory bodies in the container in accordance with an overall disturbance pattern (S) with a body at each of a plurality of local disturbance regions (L) so that the vibratory bodies in the disturbance pattern (S) transmit wave energy throughout the precipitation zone.

4. A method according to claim 3 and including defining a disturbance zone within predetermined distances above the bottom of the container and encompassing an area over the entire base area of the container, and substantially filling the disturbance zone with wave energy, the disturbance zone being defined so that it encompasses the volume of the precipitation zone (4.2).

5. A method according to claim 2 wherein the vibratory bodies are strings under tension immersed in the liquid and the vibrations are generated by repeatedly plucking the strings.

6. A method according to claim 2 wherein the vibratory bodies are bells immersed in the of liquid and the vibrations are generated by repeatedly striking the bells.

7. A method according to claim 1 wherein the vibrations are created at a sub-audible frequency.

8. A method for inhibiting sedimentation or stratified thickening in a container containing a liquid having a tendency to form a sedimentation precursor followed by deposit of sediment in a precipitation zone adjacent the bottom of the container, the method comprising, prior to the deposit of sediment on the bottom of the container, establishing a three-dimensional array of a multiplicity of disturbance zones in the thickening precipitation zone; and creating disturbances of the liquid at all of the disturbance zones within the liquid throughout the precipitation zone to disturb the formation of the precursor and thereby inhibit precipitation.

9. A method according to claim 8 and including creating the disturbances in substantially permanent operation.

* * * * *